US011192268B2

(12) United States Patent
Dahill et al.

(10) Patent No.: US 11,192,268 B2
(45) Date of Patent: Dec. 7, 2021

(54) SCORING KNIFE

(71) Applicant: TECHTRONIC CORDLESS GP, Anderson, SC (US)

(72) Inventors: Drew A. Dahill, Pendleton, SC (US); Nicholas A. Costanzo, Greenville, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 0 days.

(21) Appl. No.: 16/897,487

(22) Filed: Jun. 10, 2020

(65) Prior Publication Data

US 2020/0298430 A1 Sep. 24, 2020

Related U.S. Application Data

(63) Continuation of application No. 16/002,445, filed on Jun. 7, 2018, now Pat. No. 10,710,256.

(60) Provisional application No. 62/520,825, filed on Jun. 16, 2017.

(51) Int. Cl.

| | |
|---|---|
| ***B26B 11/00*** | (2006.01) |
| ***B25D 3/00*** | (2006.01) |
| ***B26B 3/08*** | (2006.01) |

(52) U.S. Cl.

CPC ..... *B26B 11/006* (2013.01); *B25D 3/00* (2013.01); *B26B 3/08* (2013.01); *B25D 2222/42* (2013.01); *B25D 2222/51* (2013.01)

(58) Field of Classification Search

CPC ..... B26B 3/08; B26B 11/006; B25D 2222/42; B25D 3/00; B25D 2222/51; B25F 1/02; B44D 3/164; B25G 1/085; B25G 1/04; B25G 3/00

USPC ..... 30/299, 139, 151–162, 169, 172, 353, 30/355, 337, 167.1, 167.2, 352; 7/105, 7/143, 165, 167, 144, 146, 158, 169, 138; 15/105; D8/16, 19, 14, 26, 33, 40, 43.45, D8/55, 71, 88, 89, 107

See application file for complete search history.

(56) References Cited

U.S. PATENT DOCUMENTS

| | | | | |
|---|---|---|---|---|
| 1,777,029 | A | 9/1930 | Bradford | |
| 2,297,984 | A | 10/1942 | Bratcher | |
| 2,542,582 | A | 2/1951 | Schwork | |
| 2,787,204 | A | 4/1957 | Leckenby | |
| 2,847,758 | A | 8/1958 | Kozan | |
| 3,355,804 | A | 12/1967 | Rothe | |
| 3,601,893 | A | 8/1971 | Knox | |
| 4,010,542 | A | 3/1977 | Richardson et al. | |
| D245,831 | S | 9/1977 | West et al. | |
| 4,790,388 | A | 12/1988 | Badham | |
| 5,458,341 | A * | 10/1995 | Forrest | F42B 6/08 473/583 |

(Continued)

*Primary Examiner* — Ghassem Alie

(74) *Attorney, Agent, or Firm* — Michael Best & Friedrich LLP

(57) ABSTRACT

A knife including a body with a first end, a second end opposite the first end, and a longitudinal axis that extends centrally through the first end and the second end. The knife further includes a first scoring tip that points in a first direction, a second scoring tip that points in a second direction opposite the first direction, and a scoring tip axis that extends centrally through the first scoring tip and the second scoring tip. The scoring tip axis is perpendicular to the longitudinal axis. A chisel extends from the second end of the body and the longitudinal axis of the body extends centrally through the chisel.

18 Claims, 2 Drawing Sheets

(56) References Cited

U.S. PATENT DOCUMENTS

| | | | | |
|---|---|---|---|---|
| 5,635,845 | A | 6/1997 | Strong et al. | |
| 5,931,751 | A * | 8/1999 | Cooper | F42B 6/08 473/583 |
| 5,979,058 | A | 11/1999 | Henke | |
| 6,009,581 | A | 1/2000 | Davis et al. | |
| 6,058,539 | A | 5/2000 | Mitford-Taylor | |
| 6,415,874 | B1 | 7/2002 | Gritzmacher | |
| D486,051 | S | 2/2004 | Parry | |
| D521,331 | S | 5/2006 | Zarb | |
| D528,394 | S * | 9/2006 | Lothe | D8/12 |
| 7,713,151 | B2 | 5/2010 | Fulton | |
| 7,818,843 | B2 | 10/2010 | Kinskey et al. | |
| D639,631 | S | 6/2011 | Kempker | |
| 8,250,767 | B1 | 4/2012 | Ciccarella et al. | |
| 8,167,747 | B2 * | 5/2012 | Hawthorne | F42B 6/08 473/583 |
| D693,077 | S | 11/2013 | Thompson | |
| D721,557 | S | 1/2015 | Ward | |
| 2007/0161438 | A1 * | 7/2007 | Fulton | F42B 6/08 473/583 |
| 2009/0255132 | A1 | 10/2009 | Hoover et al. | |
| 2010/0077890 | A1 | 4/2010 | Neiser et al. | |
| 2010/0293796 | A1 | 11/2010 | Votolato | |
| 2012/0272459 | A1 * | 11/2012 | Trice | B25F 1/00 7/144 |
| 2013/0126575 | A1 | 5/2013 | Mallet | |
| 2014/0068950 | A1 | 3/2014 | Taylor | |
| 2014/0345146 | A1 | 11/2014 | Schekalla | |
| 2015/0182091 | A1 | 7/2015 | Epting | |

* cited by examiner

SCORING KNIFE

CROSS-REFERENCE TO RELATED APPLICATIONS

This application is a continuation of U.S. patent application Ser. No. 16/002,445, filed Jun. 7, 2018, which claims priority to U.S. Provisional Patent Application No. 62/520,825, filed Jun. 16, 2017, the entire contents of which are hereby incorporated by reference herein.

BACKGROUND

The present invention relates to knives, more particularly to knives that are used to score a workpiece so that the workpiece can be bent along the score line to split or cut the workpiece.

SUMMARY

In one aspect the invention provides a knife including a body having a first end, a second end opposite the first end, and a longitudinal axis that extends centrally through the first end and the second end. The knife further includes a first scoring tip that points in a first direction, a second scoring tip that points in a second direction opposite the first direction, and a scoring tip axis that extends centrally through the first scoring tip and the second scoring tip. The scoring tip axis is perpendicular to the longitudinal axis. A chisel extends from the second end of the body and the longitudinal axis of the body extends centrally through the chisel.

In another aspect the invention provides a knife including a body having a first end, a second end opposite the first end, and a longitudinal axis that extends centrally through the first end and the second end. The knife further includes a first scoring tip that points in a first direction, a second scoring tip that points in a second direction opposite the first direction, and a scoring tip axis that extends centrally through the first scoring tip and the second scoring tip. The scoring tip axis is perpendicular to the longitudinal axis. The knife further includes a first blade hook adjacent the first scoring tip, the first blade hook between the first scoring tip and the longitudinal axis of the body along the scoring tip axis. A second blade hook is adjacent the second scoring tip, the second blade hook between the second scoring tip and the longitudinal axis of the body along the scoring tip axis.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
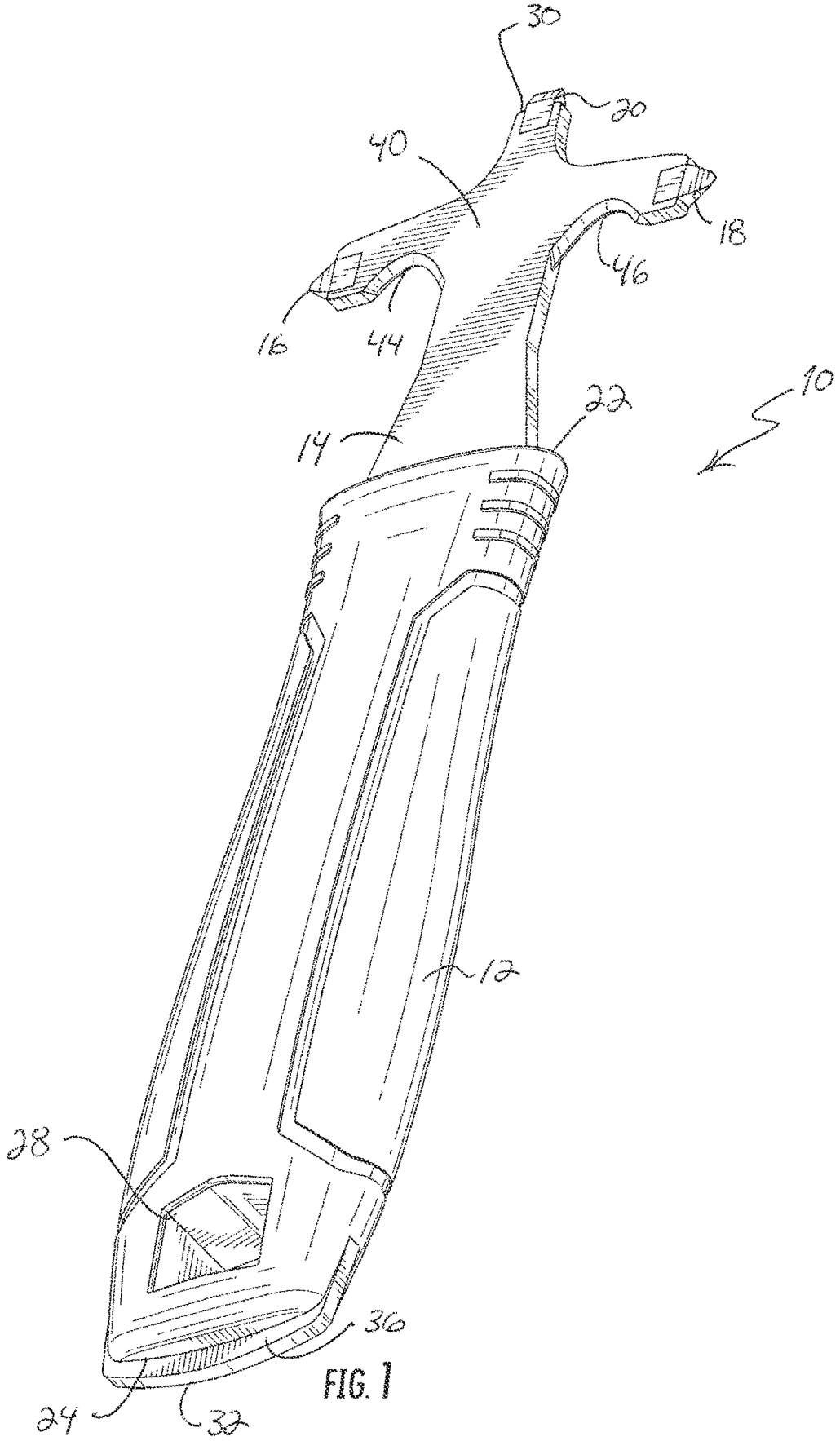
FIG. 1 is a perspective view of a scoring knife according to an embodiment of the invention.

FIG. 1 illustrates a knife 10. The illustrated knife 10 is a scoring knife particularly suited for scoring workpieces that are then split or broken along the score line to cut the workpiece. For example, cement backer board for tile is cut by scoring a line along the board (i.e., not cutting through the board). The board is then bent and broken along the score line to split or cut the board. Any material that is not broken, such as mesh, backing tape, etc. can then be cut with the knife 10. Other materials that are cut using a similar process include drywall, gypsum, HARDIE backerboard, and the like.

Figure 2:
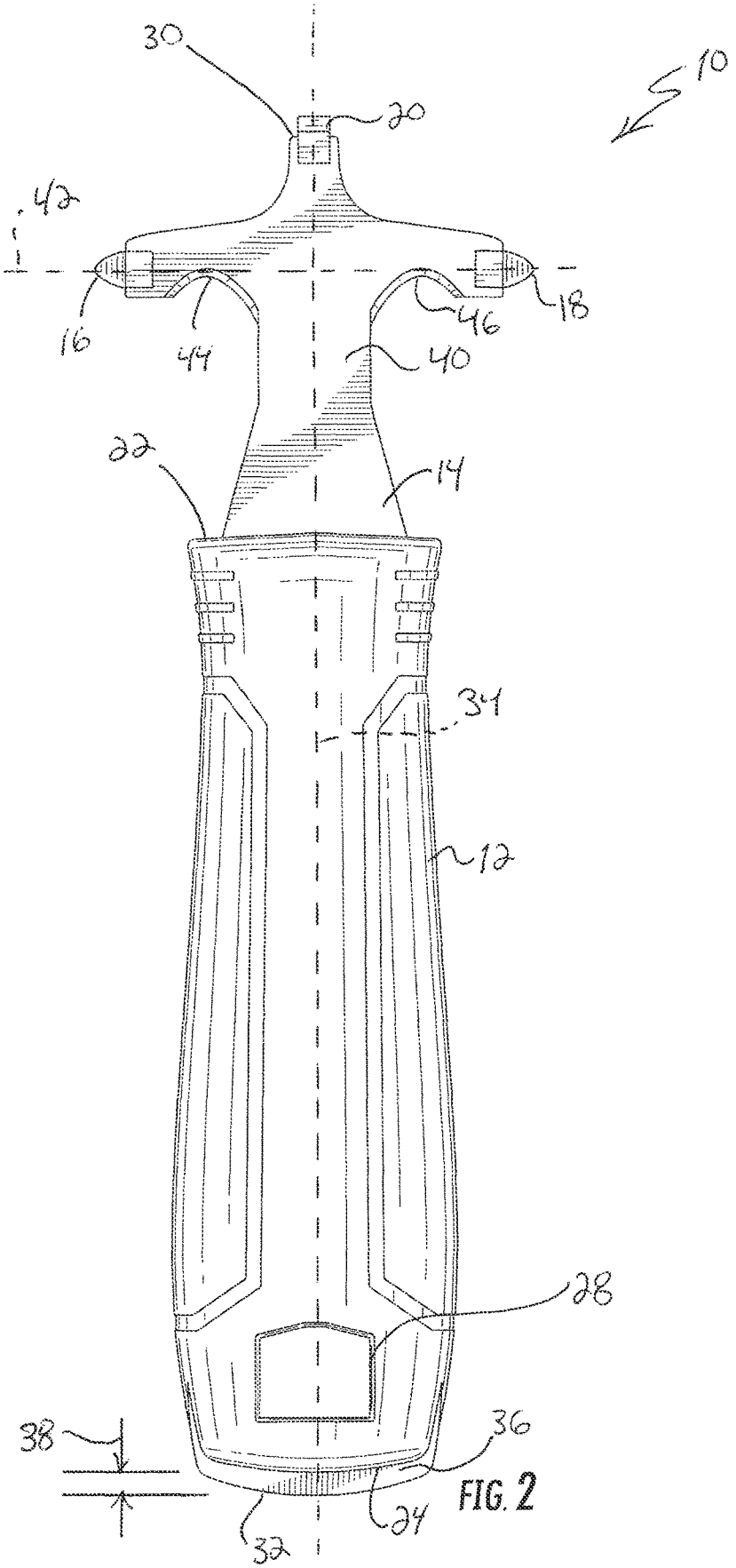
FIG. 2 is a side view of the knife of FIG. 1.

Referring to FIG. 2, the knife 10 includes a handgrip 12, a body 14, a first scoring tip 16, a second scoring tip 18, and a chisel 20. The handgrip 12 includes a first end 22 and a second end 24. An aperture 28 is located adjacent the second end 24 of the handgrip 12. The aperture 28 is used to hang the knife 10. In some embodiments, the handgrip 12 is formed from rubber or plastic. In other embodiments, other suitable types of material can be used to form the handgrip 12.

The body 14 extends through the handgrip 12 and includes a first end 30, a second end 32, and a longitudinal axis 34 that extends centrally through the first end 30 and the second end 32 of the body 14. A portion 36 of the body 14 extends beyond the second end 24 of the handgrip 12 so that the second end 32 of the body 14 is spaced a distance 38 from the second end 24 of the handgrip 12. In one embodiment, the body 14 is formed from steel and is harder and more durable than the material of the handgrip 12. The exposed second end 32 of the body 14 provides a location for the user to hammer or strike to use the chisel 20. In the illustrated embodiment, the body 14 is formed from a single piece of steel.

A portion 40 of the body 14 extends beyond the first end 22 of the handgrip 12. The scoring tips 16, 18 and the chisel 20 are attached to the portion 40 of the body 14. The chisel 20 extends from the first end 30 of the body 14 and the longitudinal axis 34 of the body 14 extends centrally through the chisel 20. In one embodiment, the chisel 20 is formed from a material such as carbide or hardened steel that is more suitable for cutting than the steel of the body 14. The scoring tips 16, 18 are coupled to the body 14 between the first end 30 of the body 14 and the first end 22 of the handgrip 12. The scoring tips 16, 18 point in opposite directions and are coupled to the body 14 on opposite sides of the longitudinal axis 34 of the body 14. A scoring tip axis 42 extends centrally through both scoring tips 16, 18. The scoring tip axis 42 intersects the longitudinal axis 34 of the body 14 and the axis 42 is perpendicular to the axis 34. In one embodiment, the scoring tips 16, 18 are formed from a material such as carbide or hardened steel that is more suitable for cutting than the steel of the body 14.

A first blade hook 44 is located adjacent the first scoring tip 16. The first blade hook 44 is located between the first scoring tip 16 and the longitudinal axis 34 along the scoring tip axis 42. The first blade hook 44 is between the scoring tip axis 42 and the first end 22 of the handgrip 12. In the illustrated embodiment, the scoring tip axis 42 forms a tangent line of the curved blade hook 44. The blade hook 44 generally faces toward the second end 32 of the body 14. A second blade hook 46 is located adjacent the second scoring tip 18. The second blade hook 46 is located between the second scoring tip 18 and the longitudinal axis 34 along the scoring tip axis 42. The second blade hook 46 is between the scoring tip axis 42 and the first end 22 of the handgrip 12. In the illustrated embodiment, the scoring tip axis 42 forms a tangent line of the curved blade hook 46. The blade hook 46 generally faces toward the second end 32 of the body 14. The blade hooks 44, 46 are formed from a sharpened portion of the body 14 in the illustrated embodiment. In other embodiments, the blade hooks 44, 46 can be formed from a cutting insert or attachment.

As shown in FIG. 2, the illustrated knife 10 is symmetrical on both sides of the axis 34.

In one method of operation, the knife 10 is used to cut cement backer board that is used as a substrate for tiles (e.g., floor or shower tiles). To cut the board, either tip 16 or 18 is used to score a line (straight or curved) on the board. The score line does not extend all the way through the board. After scoring the board, the user bends the board along the score line, which causes the board to fracture and split along the score line. The cement backer board may include a mesh material within the board (or as an outer surface of the board) that does not facture or cut when the board is bent. Either blade hook 44 or 46 is then drawn along the fracture or split line to cut the mesh material so that the board is separated and fully cut along the score line. In some applications, the material cut or scored includes a backing paper or tape (e.g., drywall). The backing paper can also be cut using the hooks 44, 46. After splitting the cement backer board there may be projections or pieces of the board that extend out from the cut edge (i.e., the cut edge is not flush or straight). Any projections can be removed by using the chisel 20, which may include using a hammer or the like to hit the second end 32 of the body 14. The chisel 20 can also be used to form holes or cutouts in the cement board.

What is claimed is:

1. A scoring knife comprising:

a handgrip having a first end and a second end opposite the first end;

a single piece body having a first end and a second end opposite the first end, the body extends at least partially through the handgrip so a first portion of the body extends beyond the first end of the handgrip;

a first scoring member attached to the first portion of the body, the first scoring member including a first scoring tip that points in a first direction;

a second scoring member attached to the first portion of the body, the second scoring member including a second scoring tip that points in a second direction opposite the first direction;

a chisel that extends from the first end of the body;

a longitudinal axis that extends centrally through the first end and the second end of the body, the first end and the second end of the handgrip, and the chisel, and a scoring tip axis that extends centrally through the first scoring member and the second scoring member, the scoring tip axis perpendicular to the longitudinal axis, wherein the chisel has an elongated cutting edge that extends parallel to the scoring tip axis.

2. The scoring knife of claim 1, wherein a second portion of the body extends beyond the second end of the handgrip so the second end of the body is spaced a distance from the second end of the handgrip.

3. The scoring knife of claim 1, wherein the handgrip is formed from a first material and the body is formed from a second material different than the first material.

4. The scoring knife of claim 3, wherein the first material is selected from the group consisting of: rubber and plastic, and wherein the second material includes steel.

5. The scoring knife of claim 4, wherein the first scoring member and the second scoring member are formed from a third material that is different than the first and second materials.

6. The scoring knife of claim 1, wherein the first scoring member extends from the first portion of the body and has a tapered profile so the first scoring tip converges to a first point on the scoring tip axis, wherein the second scoring member extends from the first portion of the body and has a tapered profile so the second scoring tip converges to a second point on the scoring tip axis.

7. The scoring knife of claim 1, further comprising a first blade hook adjacent the first scoring member, the first blade hook between the first scoring member and the longitudinal axis of the body along the scoring tip axis.

8. The scoring knife of claim 7, further comprising a second blade hook adjacent the second scoring member, the second blade hook between the second scoring member and the longitudinal axis of the body along the scoring tip axis.

9. The scoring knife of claim 8, wherein the first and second blade hooks are between the scoring tip axis and the first end of the body along the longitudinal axis, and wherein the first and second blade hooks each face towards the second end of the body.

10. The scoring knife of claim 8, wherein the scoring tip axis intersects the longitudinal axis.

11. A scoring knife comprising:

a handgrip having a first end and a second end opposite the first end;

a body having a first end, a second end opposite the first end, and a longitudinal axis that extends centrally through the first end and the second end of the body, the body extends at least partially through the handgrip so a first portion of the body extends beyond the first end of the handgrip;

a first scoring tip attached to the first portion of the body, the first scoring tip points in a first direction and is configured to form a score line on a cement backer board;

a second scoring tip attached to the first portion of the body, the second scoring tip points in a second direction opposite the first direction and is configured to form a score line on the cement backer board;

a scoring tip axis that extends centrally through the first scoring tip and the second scoring tip, the scoring tip axis perpendicular to the longitudinal axis;

a first blade hook formed on the first portion of the body that is configured to cut the cement backer board along the score line formed by the first scoring tip or the second scoring tip, the first blade hook extends between the first scoring tip and the longitudinal axis of the body along the scoring tip axis;

a second blade hook formed on the first portion of the body that is configured to cut the cement backer board along the score line formed by the first scoring tip or the second scoring tip, the second blade hook extends between the second scoring tip and the longitudinal axis of the body along the scoring tip axis; and a chisel that extends from the first end of the body, the longitudinal axis of the body extends centrally through the chisel, the chisel having an elongated cutting edge that extends parallel to the scoring tip axis.

12. The scoring knife of claim 11, wherein a second portion of the body extends beyond the second end of the handgrip and the second end of the body is spaced a distance from the second end of the handgrip to provide a location for a user to strike during use of the chisel.

13. The scoring knife of claim 12, wherein the handgrip is formed from a first material and the body is formed from a second material different than the first material.

14. The scoring knife of claim 13, wherein the first material includes rubber or plastic so the user can grasp the handgrip, and wherein the second material includes steel so the user can strike the second end of the body.

15. The scoring knife of claim 14, wherein the first scoring tip and the second scoring tip are formed from a third material that is different than the first and second materials.

16. The scoring knife of claim 11, wherein the first and second blade hooks are between the scoring tip axis and the first end of the body along the longitudinal axis, and wherein the first and second blade hooks face towards the second end of the body.

17. The scoring knife of claim 11, wherein the first scoring tip extends from the first portion of the body and has a tapered profile that converges to a first point on the scoring tip axis, wherein the second scoring tip extends from the first portion of the body and has a tapered profile that converges to a second point on the scoring tip axis.

18. The scoring knife of claim 11, wherein the body is a single piece.

* * * * *